US005877444A

United States Patent [19]

Hine et al.

[11] Patent Number: 5,877,444

[45] Date of Patent: Mar. 2, 1999

[54] TUNER FOR STRINGED MUSICAL INSTRUMENTS

[75] Inventors: Arthur H. Hine, 5892 - 188th Street, Surrey, B.C., Canada, V3S 7M1; Timothy Collings, White Rock, Canada

[73] Assignee: Arthur H. Hine, Canada

[21] Appl. No.: 821,788

[22] Filed: Mar. 21, 1997

[51] Int. Cl.[6] ..... G10G 7/02

[52] U.S. Cl. ..... 84/454; 84/455; 84/477 R; 84/DIG. 18

[58] Field of Search ..... 84/454, 455, 477 R, 84/DIG. 18

[56] References Cited

U.S. PATENT DOCUMENTS

| | | | |
|---|---|---|---|
| 3,901,120 | 8/1975 | Youngquist | 84/454 |
| 4,312,044 | 1/1982 | Baba | 364/554 |
| 4,318,327 | 3/1982 | Toups . | |
| 4,338,846 | 7/1982 | Pogoda | 84/1.24 |
| 4,434,697 | 3/1984 | Roses | 84/456 |
| 5,070,754 | 12/1991 | Adamson . | |
| 5,323,680 | 6/1994 | Miller et al. | 84/455 |
| 5,371,511 | 12/1994 | Atherton, Jr. et al. | 345/38 |
| 5,388,496 | 2/1995 | Miller et al. | 84/454 |
| 5,396,827 | 3/1995 | Miller et al. | 84/454 |
| 5,408,914 | 4/1995 | Breitweiser, Jr. et al. . | |
| 5,455,381 | 10/1995 | Juszkiewicz et al. | 84/731 |
| 5,637,820 | 6/1997 | Wittman | 84/454 |

*Primary Examiner*—William M. Shoop, Jr.
*Assistant Examiner*—Marlon T. Fletcher
*Attorney, Agent, or Firm*—Hall, Priddy & Myers

[57] ABSTRACT

A tuner for stringed musical instruments which has a transducer pickup for converting sound vibrations of the strings to electrical signals and a body being either hollow or solid with a front and back surface and a edge surface extending between the front and back surface. The tuner has a tuner circuit attachable to an interior of the sound box with an input couplable to an output of the transducer and a digital display positionable on one of the edge or front surfaces of the body so that it faces a player when the instrument is in a playing position.

5 Claims, 4 Drawing Sheets

TUNER FOR STRINGED MUSICAL INSTRUMENTS

The present invention relates to a digital electronic tuner for stringed musical instruments, particularly designed to be implanted into the sound box of a the musical instruments with a display positionable to face a user.

BACKGROUND

Electronic tuners for stringed musical instruments use some kind of pickup head to sense the sound vibrations corresponding to the note being played and convert that vibration to an electrical signal. Some tuners use microphones to pick up the tone from air-transmitted sound but such detection is susceptible to error or difficulty in tuning due to ambient noise also picked up by the microphone. The operation of such circuits involves first amplifying and filtering the signal, and then detecting it in a microprocessor to determine the fundamental frequency of the tone being detected utilizing a suitable tuning algorithm. In some circuits this frequency is compared with the true fundamental frequencies of the notes which are stored in processor memory. The frequency of the closest note to the detected frequency of the tone being detected is determined after which various outputs may be provided. Some outputs use a series of flashing lights in the form of light emitting diodes to indicate the closest note. U.S. Pat. No. 5,388,496 issued to Miller et al. discloses an additional output which indicates whether the frequency of the detected tone is above or below the frequency of the closest note. Other kinds of displays such as a null meter, an oscilloscope screen, or coloured lights have been used. U.S. Pat. No. 4,312,044 issued to Baba and U.S. Pat. No. 4,434,697 issued to Roses discloses use of a multi-digit segment display and an alphanumeric display, respectively.

The location of the electronics and display of known guitar tuners ranges from units which are contained in separate boxes as in U.S. Pat. No. 3,901,120 issued to Youngquist to a display in the form of a series of flashing lights on the edge of the guitar finger board as in Miller et al., supra. In Miller et al. the light display is connected by a cable to a casing mounted within the sound box of a guitar. For such an arrangement as in Miller, it would be necessary for a user to memorize which lights correspond to which notes as well as which colours indicate an out-of-tune tone being higher than the frequency of the note being played and which colours indicate an out-of-tune tone being lower than the frequency being played. It would also be necessary in Miller, supra., to connect the external cable from the casing within the sound box to the light display when it is desired to use the tuner.

Accordingly, it is an object of the invention to provide an improved tuner for a stringed musical instrument. It is a further object of the invention to provide a tuner for stringed musical instruments having an improved display. It is yet a further object to provide a tuner for stringed musical instruments implanted into the box and positionable so that it faces a user during tuning.

SUMMARY OF THE INVENTION

According to the invention there is provided a tuner for stringed musical instruments which has a transducer for converting sound vibrations of the strings to electrical signals and a body, either hollow or solid, with a front and back surface and an edge surface extending between the front and back surface. The tuner has a tuner circuit mountable in an interior of said body, with an input of the tuner circuit having an input couplable to an output of said transducer. An output of the tuner circuit is connected to a digital display mountable to a surface of the body and positioned or positionable so that it is visible to a player when the instrument is in a playing position.

Preferably the digital display displays alphabetically a note closest to a fundamental frequency of a tone being detected and whether the frequency of the detected tone is higher or lower than or equal to the frequency of the note.

The display may be mounted on an edge surface of the instrument facing a user.

The display may have two 14 segment displays one of which displays the note and another whether the tone has the same frequency as the note, or whether it is above or below the note.

Advantageously, a first vertical segment flashes when the tone has a frequency above that of the note, a second vertical segment flashes when the tone has a frequency below that of the note and an horizontal segment flashes when the tone has the same frequency as the note. The rate of flashing of the vertical segments is proportional to the difference in frequency of the tone and the note.

Alternatively, the display may be pivotally mounted on a front surface of the instrument and spring-biased so as to be visible to a user when the instrument is in a playing position, with a catch to hold said display substantially along the front surface when not in use and releasable upon pressure being applied to said display.

The tuner circuit may have a start button to activate the power to said tuning circuit and a timing circuit which powers down the tuner circuit on timing out.

The tuner circuit may include a battery, a voltage regulator and a pass transistor in series with the battery and the voltage regulator, the gate of said pass transistor being grounded by pressing the start button and a timing circuit having an RC circuit coupled from the gate to the positive battery output to charge up and raise the voltage on the gate until the pass transistor cuts off.

The tuner may further include an amplifier couplable to the transducer output, a digitizer which detects the frequency of the amplified signal and produces a square wave signal of a frequency equal to the frequency of said amplified signal, a processor coupled to the square wave signal and operative to detect the fundamental frequency of the square wave signal and compare it to frequencies of stored frequency values corresponding to notes of a musical scale and determine a note having the closest frequency and whether the detected frequency of the square wave signal is higher or lower than or equal to the frequency of the note having the closest frequency. A digital display may be coupled to the processor and operative to display the note having the closest frequency and whether the fundamental frequency of the tone being detected is higher or lower than or equal to the frequency of the note having the closest frequency.

Preferably, said digital display provides a flashing display to indicate whether a tone is higher or lower in frequency than the note and flashes with a frequency that is in proportion to the difference in frequency between the note and the tone.

In another aspect of the invention there is provided a guitar having body either hollow or solid with a front and back surface joined by an edge surface, a transducer which converts sound vibrations from the strings to electrical signals, and a tuner. The tuner circuit is mounted in an interior of the body and has an input coupled to an output of the transducer and a digital display mounted on one of the edge and front surfaces and positionable such that it faces a player when the guitar is in a playing position.

Preferably, the display is mounted on and substantially flush to the edge surface and the tuner circuit is mounted in an interior of the body.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
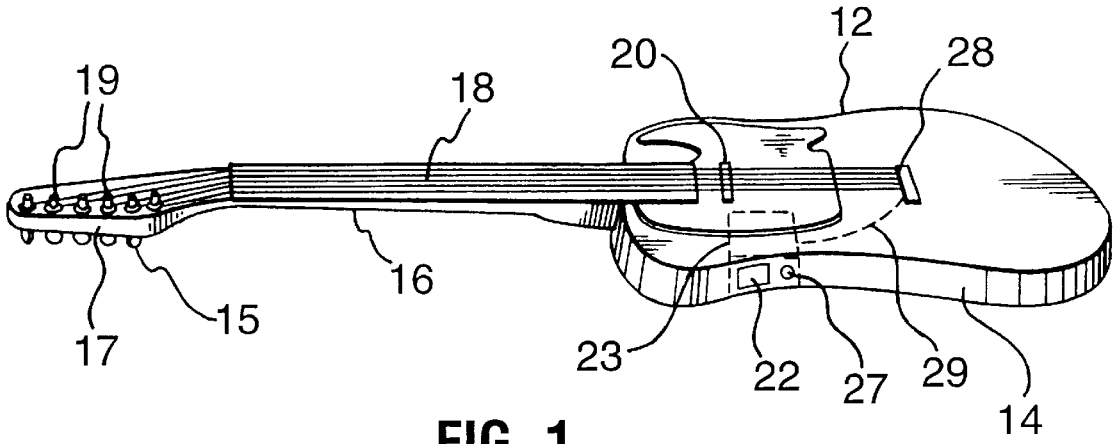
FIG. 1 is a perspective view of a guitar showing the tuner display on the edge of the body.

Referring to FIG. 1 there is shown a conventional electric guitar 12 consisting of a body 14 having a pickup 20, a neck 16, and a head stock 17. Body 14 can be either hollow as in a conventional guitar or solid as in an electric guitar. Head stock 17 has six tuning heads 19 around which the ends of six guitar strings 18 are wound. The tuning heads 19 are adjusted by lugs 15. The strings pass over a pickup 20 containing a transducer 30 (see FIG. 3) and terminate on the sound box 14 with bridge pins 28. A digital display 22 is mounted in the edge of the body 14 in a location where a player can readily view it. Shown in dotted lines is the tuner 23 which contains a tuner battery 32 to operate the tuner electronics shown in FIG. 3. The tuner 23 is connected electrically to an output of the transducer 30 by line 29. Button 27 is the start button which activates the tuner 23.

Figure 2:
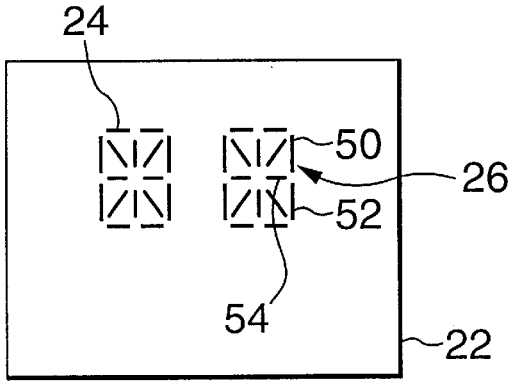
FIG. 2 is a front elevation view of the display.

Referring to FIG. 2 the display consists of two 14 segment display elements 24 and 26. Display 24 displays aphabetically the letter of the note which is closest to the fundamental frequency of the note that is being detected. For example, notes that are displayed by the first segment display element 24 are as follows:

$A^b$, A, $B^b$, B, C, $D^b$, D $E^b$, E, F, $G^b$, G

Display 26 displays whether the frequency of the tone being detected is higher or lower than the frequency of the actual note. A tone of a frequency higher than that of the note is displayed as a flashing vertical segment 50 while that of a frequency lower than that of the note is displayed as a flashing vertical segment 52. The rate of flashing is proportional to the difference in frequency of the tone and the note. Horizontal segment 54 flashes when the tone is of the same frequency as that of the note.

Figure 3:
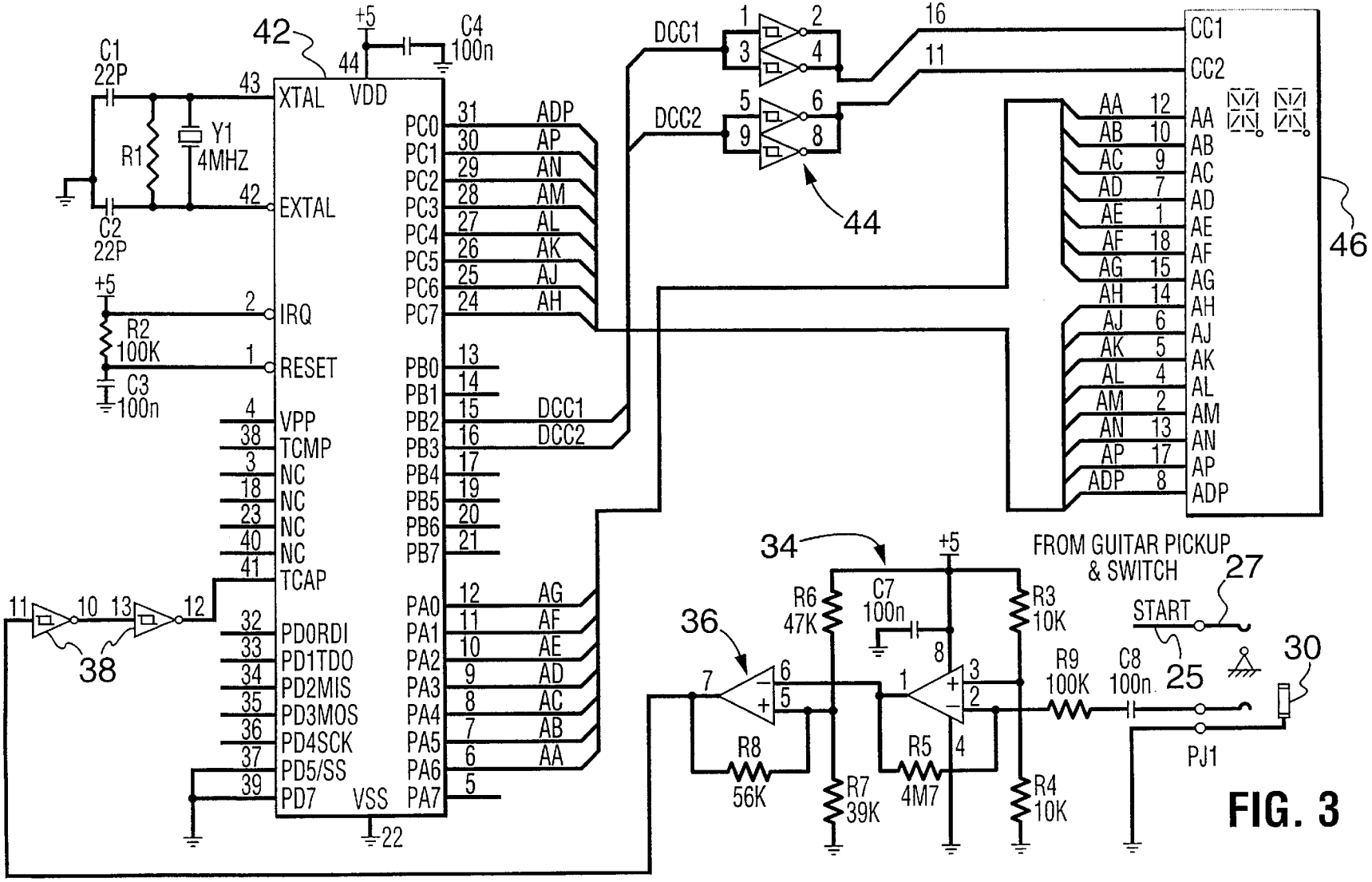
FIG. 3 is a circuit diagram of the electrical circuit of the tuner.
Figure 3:
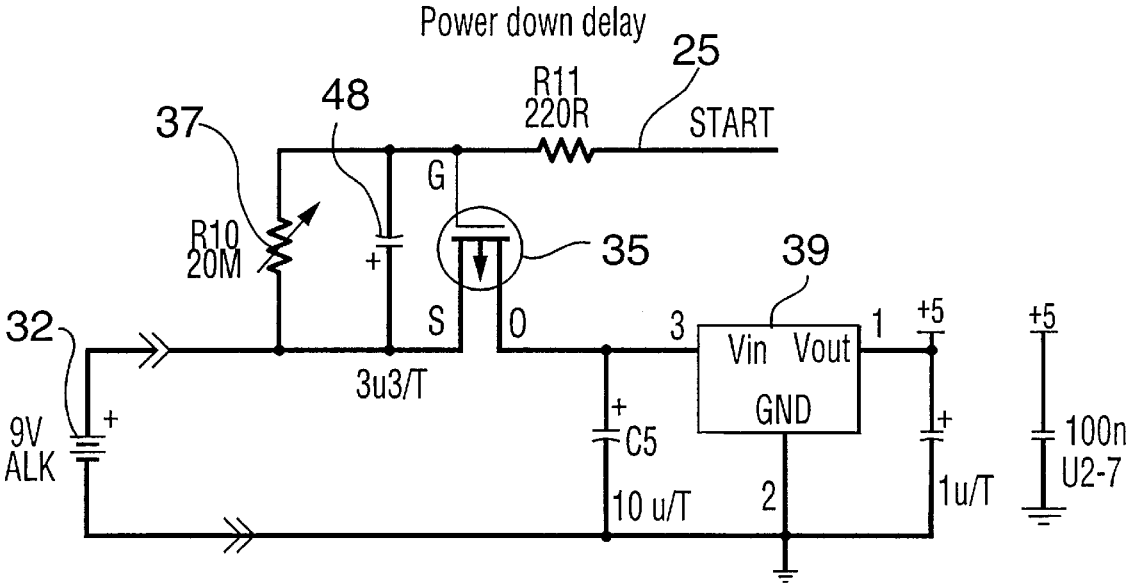

Referring to FIG. 3, the tuner electronics is powered by a 9 volt alkaline battery 32. An NMOS FET transistor 35 is in series with the battery 32 and a regulator 39. The regulator provides a regulated +5 volt output for the rest of the electronics. Transistor 35 is activated when start button 27 is pressed to contact ground biasing the gate of transistor 35 below its source and drain and causing it to conduct and power the regulator 39. Capacitor 48 begins charging through resistor 37 from 0 volts towards 9 volts with an RC time constant that is selected to allow operation for the desired time period. This time constant can be adjusted but is conveniently set so that the transistor 35 conducts for about 1 minute and then powers down the circuitry. This automatic power down feature saves battery power and avoids the problem of inadvertently leaving on the tuner and draining the battery.

Electrical signals from the transducer 30 are applied to the inverting input of an amplifier 34 and then to comparator 36 which compares the amplified signal to 2 ¼ volts set by the resistor chain R6 and R7. The effect of comparator 36 is to have an output swing whenever the amplified voltage crosses the 2 ¼ volt level. The signals from the comparator 36 are shaped by one-shots 38 and then applied as digital signals to the processor 42. The processor 42 is programmed with a tuning algorithm which determines the fundamental frequency of the detected tone. The output of the processor 42 is applied to the dual 14 segment digital display 46 so as to display the note with the closest frequency and whether or not the frequency of the detected tone is higher or lower than the frequency of the note with the closest frequency.

Figure 4:
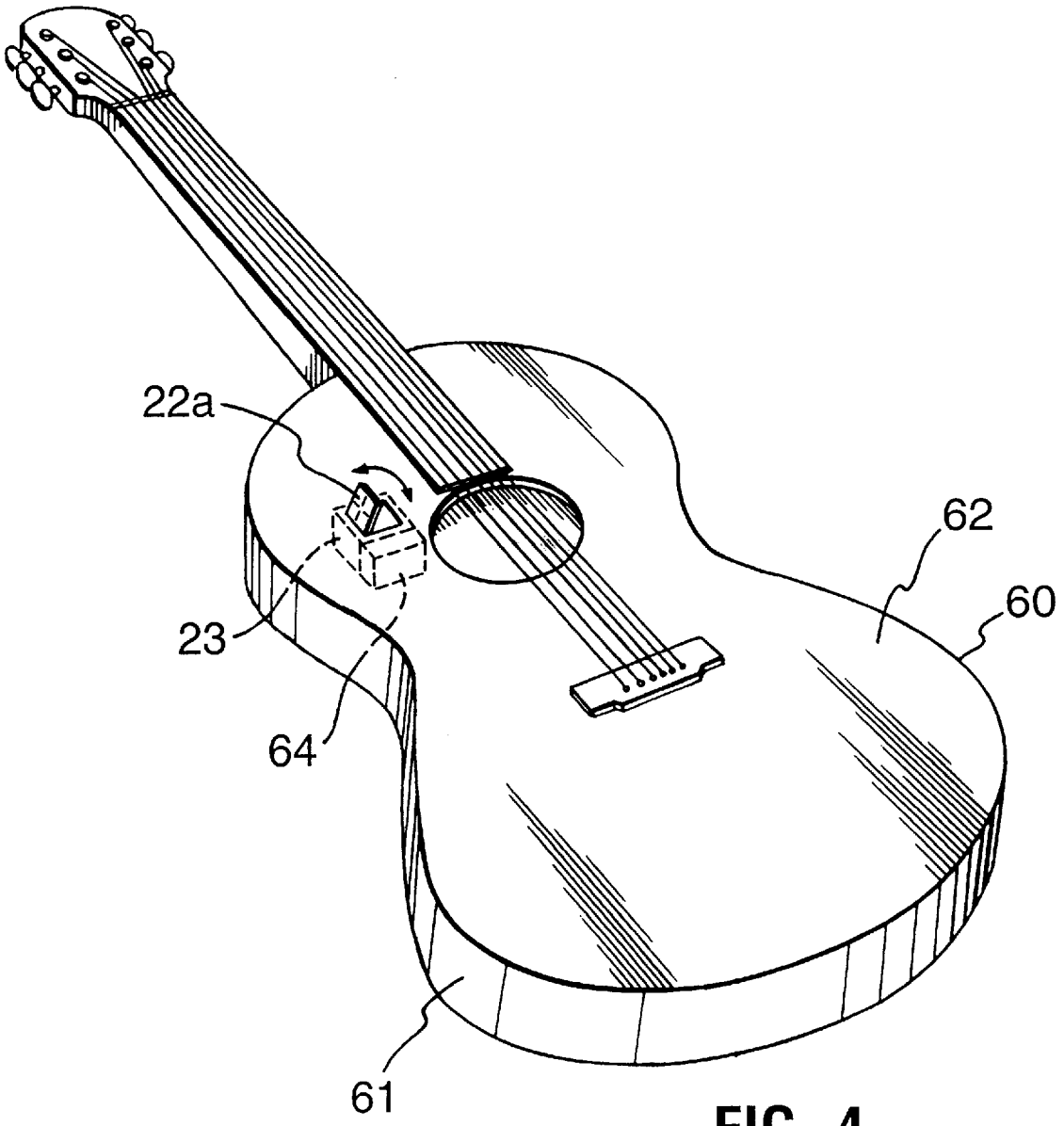
FIG. 4 is a perspective view of a guitar with a hollow body.

Referring to FIG. 4 there is shown a guitar 60 having a hollow body 61 with a top surface 62. In an opening in the front surface 62 there is pivotally mounted a 14 segment display 22*a* which is spring biased towards the position shown which is visible to a user when the guitar is in a playing position. A catch which releases upon pressing down on display 22*a* (not shown) holds the display in a normally flat position in the plane of the front surface 62. Display 22*a* is coupled to an output of tuner 23 mounted inside the hollow body 61. A microphone 64 couples to an input of tuner 23.

The operation of the tuner in FIG. 4 is otherwise the same as that of FIGS. 1–3.

While reference has been made only to guitars, in fact, it is obvious that the tuner would also work for other stringed musical instruments such as a bass guitar.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

What is claimed is:

1. A tuner apparatus for stringed musical instruments, which instruments have a body being one of hollow or solid, with a front and back surface and an edge surface extending between the front and back surfaces, which tuner apparatus comprises:

(a) a transducer for converting sound vibrations of said strings to electrical signals, which transducer is one of:

(i) a part of said stringed instrument; and (ii) an external device coupled to said stringed instrument;

(b) a tuner circuit mountable in an interior of said body, said tuner circuit having an input couplable to a transducer output and said tuner circuit operative to produce a tuner circuit output; and (c) a digital display mountable to one of said edge surface and said front surface on a side closest to a player, said digital display being coupled to said tuner circuit output, said digital display positionable such that said digital display faces a player when said instrument is in a playing position, making said digital display easily readable when said instrument is in said playing position, and said digital display having a multi-segment display, a first portion of which is operative to automatically represent alphabetically, without reference to a corresponding mark or position, a reference note closest in frequency to a measured tone for all notes capable of being played on said stringed musical instrument, and a second portion of which is operative to represent a graphically intuitive indication of whether said measured tone has the same frequency as said reference note, whether the frequency of said measured tone is one of above and below said reference note, and a relative frequency difference between said measured tone and said reference note.

2. A tuner apparatus according to claim 1, wherein said graphically intuitive indication includes;

(a) an upper segment in the top half of said second portion of said multi-segment display, which upper segment flashes at a rate proportional to a difference between said measured tone and said reference note when said measured tone is lower in frequency than said reference note;

(b) a lower segment in the bottom half of said second portion of said multi-segment display, which lower segment flashes at a rate proportional to the difference between said measured tone and said reference note when said measured tone is higher in frequency than said reference note, and (c) an equality segment in the middle of said second portion of said multi-segment display, which equality segment is perpendicularly oriented relative to said upper and lower segments and lights when said measured tone is equal in frequency to said reference note.

3. A tuner apparatus according to claim 1, wherein said tuner circuit includes:

(a) an amplifier couplable to said transducer output, said amplifier operative to produce an amplifier output signal;

(b) a digitizer which is operative to detect the frequency of said amplifier output signal and produce a square wave signal of identical frequency to said amplifier output signal;

(c) a processor coupled to said square wave signal, said processor operative to:

(i) detect a fundamental frequency of said square wave signal and compare it to reference frequency values corresponding to notes of a musical scale;

(ii) determine a reference note having a frequency closest to said fundamental frequency of said square wave signal;

(iii) digitally determine a relative difference between said fundamental frequency of said square wave signal and said reference note; and (iv) output digital signals to operate said digital display, including a first signal operative to carry information to alpha-numerically display said reference note and a second signal operative to carry information to graphically display said relative difference between Said fundamental frequency of said square wave signal and said reference note.

4. A tuner apparatus according to claim 1, wherein said digital display is mounted within, and substantially flush to, said edge surface on a side closest to said player, said display facing said player when said instrument is in a playing position.

5. A tuner apparatus for stringed musical instruments, which instruments have a body being one of hollow and solid, with a front and back surface and an edge surface extending between the front and back surfaces, which tuner apparatus comprises:

(a) a transducer for converting sound vibrations of said strings to electrical signals, which transducer is one of:

(i) a part of said stringed instrument; and (ii) an external device coupled to said stringed instrument;

(b) a tuner circuit mountable in an interior of said body, said tuner circuit having an input couplable to a transducer output and said tuner circuit operative to produce a tuner circuit output; and (c) a digital display pivotally mounted on said front surface of said body and spring biased so as to be facing a player, making said digital display easily readable when said instrument is in a playing position, said digital display further comprising:

(i) a catch to hold said digital display substantially flush to said front surface when not in use; and (ii) a combination power and release mechanism which mechanism is operable, when pressure is applied to said digital display, to release said catch, allowing said digital display to open and face said player, and simultaneously to power said tuner apparatus;

said digital display being coupled to said tuner circuit output, and said digital display including a multi-segment display, a first portion of which is operative to represent alphabetically, without reference to a corresponding mark or position, a reference note closest in frequency to a measured tone, and a second potion of which is operative to represent a graphically intuitive indication of whether said measured tone has the same frequency as said reference note, whether the frequency of said measured tone is one of above and below said reference note, and a relative frequency difference between said measured tone and said reference note.

* * * * *

UNITED STATES PATENT AND TRADEMARK OFFICE

CERTIFICATE OF CORRECTION

PATENT NO. : 5,877,444

DATED : March 2, 1999

INVENTOR(S) : Arthur H. Hine and Timothy Collings

It is certified that error appears in the above–identified patent and that said Letters Patent hereby corrected as shown below:

Column 5, line 14, delete ";" and substitute --:--;

line 19, after "lower" insert --and higher--.

Column 6, line 3, second instance delete "Said" and substitute --said--;

line 44, delete "potion" and substitute --portion--.

Signed and Sealed this

Twelfth Day of October, 1999

*Attest:*

Q. TODD DICKINSON

*Attesting Officer*

*Acting Commissioner of Patents and Trademarks*